United States Patent [19]

Rockola

[11] Patent Number: 4,997,106

[45] Date of Patent: Mar. 5, 1991

[54] STORAGE MAGAZINE AND FEED SYSTEM FOR VENDING CYLINDRICAL ARTICLES

[75] Inventor: Donald C. Rockola, Chicago, Ill.

[73] Assignee: Rock-Ola Manufacturing Corporation, Addison, Ill.

[21] Appl. No.: 424,067

[22] Filed: Oct. 19, 1989

[51] Int. Cl.[5] ..... B65H 3/44

[52] U.S. Cl. ..... 221/95; 221/92; 221/133; 221/176; 221/195; 221/281; 221/303; 221/312 R; 221/312 B; 312/45; 312/72; 211/59.2

[58] Field of Search ..... 221/92, 95, 107, 111, 221/112, 114, 116, 118, 133, 174, 175, 176, 194, 195, 196, 197, 241, 242, 243, 244, 245, 246, 247, 281, 282, 303, 311, 312 R, 312 B; 312/45, 49, 72, 73; 211/59.2

[56] References Cited

U.S. PATENT DOCUMENTS

| | | | |
|---|---|---|---|
| 2,511,099 | 6/1950 | Case | 211/59.2 X |
| 2,956,660 | 10/1960 | Nordquist | 221/193 |
| 3,095,997 | 7/1963 | Garvin | 221/195 |
| 3,141,571 | 7/1964 | Moore | 221/195 |
| 3,322,303 | 5/1967 | Grindinger et al. | 221/298 |
| 3,323,679 | 6/1967 | Baller | 221/195 |
| 3,348,733 | 10/1967 | Johnson | 221/198 |
| 3,498,497 | 3/1970 | Baxendale et al. | 221/116 |
| 3,533,536 | 10/1970 | Baxendale et al. | 221/281 |
| 3,587,925 | 6/1971 | Keller | 221/266 |
| 3,831,806 | 8/1974 | Lindsey | 221/1 |
| 4,347,952 | 9/1982 | Bookout | 221/129 |
| 4,705,176 | 11/1987 | Oden | 211/59.2 |
| 4,712,712 | 12/1987 | Garden | 221/266 |

FOREIGN PATENT DOCUMENTS

| | | | |
|---|---|---|---|
| 866798 | 9/1941 | France | 221/133 |

*Primary Examiner*—Robert P. Olszewski
*Assistant Examiner*—C. Druzbick
*Attorney, Agent, or Firm*—McCaleb, Lucas & Brugman

[57] ABSTRACT

A storage magazine for use in coin operated automatic vending machines composed of a plurality of side-by-side vertical storage columns or magazine sections, each having at least two back-to-back aligned serpentine tracks which store a plurality of cylindrical articles and gravitationally feed the same to an underlying discharge ramp common to both tracks. The ramp cooperates with a wedge feed system for operatively integrating articles discharged from each of the tracks into a single column in which the articles from the individual tracks are arranged in alternating order for first-in, first-out vending by a single coin operated vend mechanism.

8 Claims, 1 Drawing Sheet

FIG. 1
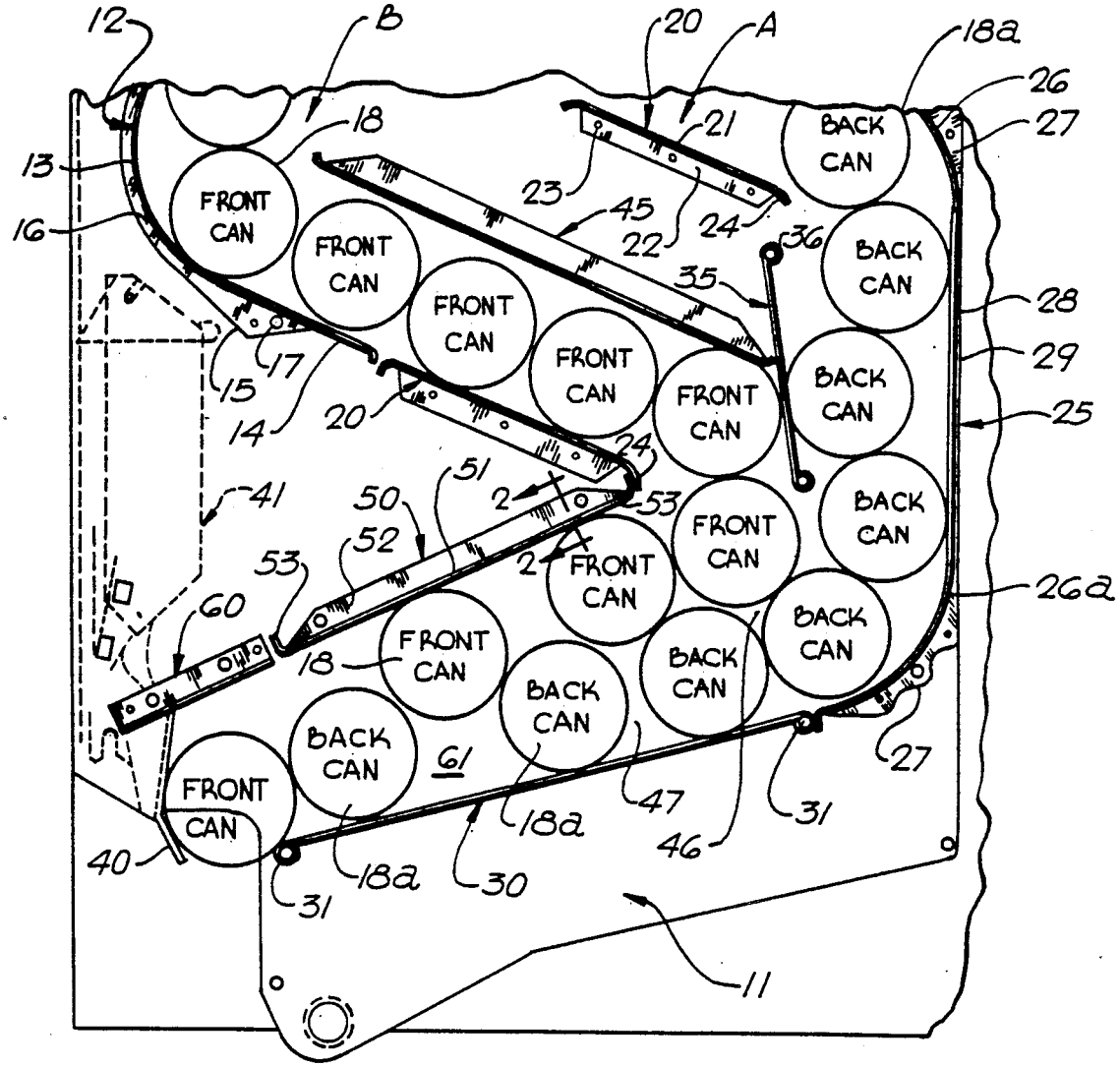
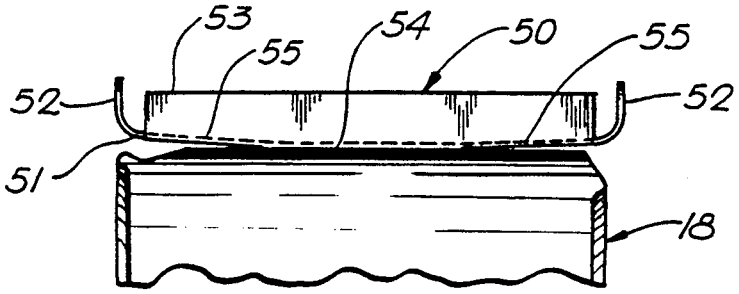
FIG. 2

STORAGE MAGAZINE AND FEED SYSTEM FOR VENDING CYLINDRICAL ARTICLES

This invention relates generally to coin operated vending machines and more particularly to improved multiple column magazines and feed systems employed therein for storing and dispensing cylindrical articles, such as canned or bottled beverages, on a first-in, first-out basis.

Storage capacity in canned or bottle vending machines is of paramount importance, particularly in view of increased demand for vending machines capable of dispensing a wider variety of beverage flavors and types. At the same time competitive pressures of the marketplace dictate ever increasing economies of manufacture.

Prior to this invention, multiple column storage magazines for can or bottle vending machines were known in which cylindrical articles were stored in a variety of configurations for coin controlled dispensing by appropriate vend mechanisms. Of such prior developments, magazines having multiple side-by-side columns or magazine sections in which articles were stored in adjacent serpentine tracks, provided material advancement in increased storage capacity. Typifying such developments are the inventions taught in U.S. Pat. Nos. 3,498,497, issued Mar. 3, 1970; 3,831,806, issued Aug. 27, 1974, which concern two interfolded serpentine tracks per magazine section wherein three cooperating serpentine rails or tracks between parallel adjacent magazine walls provide a pair of storage tracks for gravitationally feeding cylindrical articles to lower disposed vending mechanisms. A later improvement over such teaching is found in U.S. Pat. No. 4,347,952, issued Sept. 7, 1982, to the assignee hereof, in which two separated, non-overlapping back-to-back serpentine tracks in vertical magazine sections achieve improved storage capacity and space utilization.

Characteristic of such prior serpentine track developments is the requirement for a vending mechanism associated with each serpentine track in order to control vending of individual articles therefrom. Such feature takes up valuable cabinet space which otherwise would be available for added product capacity and further increases manufacturing costs of the vending machine.

BRIEF SUMMARY OF THE INVENTION

The present invention is concerned with improvements in multiple track magazine and article feed means for coin operated vending machines, having particular application to dual serpentine track magazines, although, the teachings hereof have equal application to any other type of storage magazine in which cylindrical articles are gravitationally fed into two or more separate descending columns or stacks for controlled vending thereof.

In brief, the present invention comprises a storage magazine having two or more separated, vertically oriented, back-to-back related, tracks for gravitationally guiding separate columns or stacks of generally cylindrical articles, such as canned or bottled beverages, to separate discharge locations at the lower ends thereof. A first one of the tracks guides and discharges articles directly onto an underdisposed, downwardly sloping discharge ramp leading to a single coin controlled vend mechanism located at the lower end of the ramp; the latter also passing under the lower discharge end of the other track or tracks for receiving articles therefrom. Orderly feeding of articles from the other track or tracks into the progression of articles discharged onto the ramp by the first track is effected by means of a novel wedge feed means which overlays the ramp and extends downstream from the discharge end of each secondary track and operates to integrate articles discharged therefrom into the interstices between adjacent articles on the ramp. This is done in a manner to positively deposit, by force or gravity, the secondary track articles onto the ramp, for vending by a single vend mechanism. As a consequence, the vend mechanism alternately receives and vends articles from plural tracks, one-by-one such that two or more tracks are uniformly depleted on a first-in, first-out basis.

It is a principle object of this invention to provide an improved gravity operated feed system for integrating two or more separate supply columns of gravitationally descending cylindrical articles into a single column in which articles from an adjacent columns are arranged for alternate discharge by a single vend mechanism.

It is another object of this invention to provide a storage magazine for use in automatic coin operated vending machines which incorporates a feed system of the order set out in the preceding object hereof.

It is still another object of this invention to provide a vending machine magazine, as set out in the next preceding object, which is characterized by economies of manufacture and space utilization.

A further object of this invention is to provide a storage magazine for cylindrical articles in which a plurality of gravitationally fed separated columns or streams of articles are integrated into a single common discharge stream for dispensing release one-by-one, by a single vending mechanism.

Having described this invention, the above and further objects, features and advantages thereof will be recognized by those of skill in the art from the following detailed description of a preferred embodiment illustrated in the accompanying drawings and representing the best mode presently contemplated for enabling those of skill in the art to practice this invention.

IN THE DRAWINGS

FIG. 1 is a partial side elevational view of the lower portions of a dual serpentine track magazine embodying the improved feed system of this invention; and FIG. 2 is an enlarged cross sectional view taken substantially along vantage line 2—2 of FIG. 1 and looking in the direction of the arrows thereon.

DESCRIPTION OF THE PREFERRED EMBODIMENT

With initial reference to FIG. 1 of the drawings, as therein illustrated, the lower portion of a dual serpentine track magazine, indicated generally at 10, may be constructed generally in accordance with the teachings of my co-pending application Ser. No. 07/245,451 filed Sept. 16, 1988 now U.S. Pat. No. 4,913,313, issued Apr. 3, 1990, and assigned to the assignee hereof, which teaching is incorporated by reference herein for amplified description of such a magazine structure and its operational environment in a coin operated vending machine. It will be understood, of course, that while the specifics of the fabricated magazine 10 are generally in accordance with my above referred to pending application, other vending machine magazines in which two or more separate supply columns of gravitationally descending cylindrical articles are present can be adapted to the present invention as well. Be that as it may, for present purposes a dual serpentine track magazine of the order illustrated in FIG. 1 is preferred by way of illustrating the utility and novelty of the present invention. In general a vending machine magazine of this order is made up of a number of unified sections defining vertical columns or compartments, each of which contains back-to-back separated dual serpentine front loading tracks of the general order set out in the drawings and described more fully in my aforementioned pending application.

To that end it will be understood that each magazine section comprises a pair of planar wall members 11 lying in parallel spaced relationship and onto the opposing faces of which are attached a plurality of opposing, symmetrically formed registeringly aligned, curvilinear rail sections 12 having a curvilinear body portion 13 formed at a uniform radius to approximately a half circle. The ends of such body portion merge into divergent linear leg portions 14 which extend integrally outwardly therefrom in substantial tangential relation with the curve of body portion 13. The curvilinear and linear portions 13 and 14 are formed integrally with a pair of co-planar, generally triangular shaped mounting ears 15 disposed at right angles to the linear portions 14 and extending along the curvilinear body portion 13 to provide a bead 16 which reinforces the body portion. Fastener openings 17 are provided in each mounting ear for connecting sections 12 to an adjacent wall member 11.

It will be understood that a plurality of the curvilinear sections 12 are arranged in opposing spaced relationship and arrayed vertically along the length of the opposing walls 11 to effect a serpentine column for storage of cylindrical articles therebetween, such as beverage cans 18 and 18*a* indicated as "front" and "back" cans, respectively, in FIG. 1. In this manner two separated back-to-back vertically extending serpentine track columns, partially shown herein and indicated at A and B, are provided in magazine 10 for storing a plurality of cylindrical articles.

In addition to the plurality of curvilinear rail sections 12 as illustrated, each of the track column A and B, comprises a short linear section 20 at its discharge end having a linear rail portion 21 formed at right angles to a planar mounting flange 22 provided with appropriate openings 23 for the passage of suitable fasteners used to connect the same to a wall member 11. The outer ends of the linear rail portion 21 thereof are suitably turned downwardly, as at 24, to provide a non-interfering lip over which the cans may move in their gravitational descent.

Cans leaving the linear rail portion 21 upon exit from serpentine column A encounter a vertically elongated combination curvilinear/linear rail section 25 having quarter circle curvilinear portions 26, 26*a* at its opposite ends, each fitted with a planar mounting ear portion 27 for attachment to a wall 11; such ear portions being disposed at right angles to a linear rail 28 section which extends between the curvilinear portions 26, 26*a* and is bordered by a reinforcing bead flange 29 integral with mounting ear portions 27.

The "back" cans 18*a* descend generally vertically downwardly to the lower end of the combination curvilinear and straight rail section 25 where they are guided by portion 26*a* onto an angularly downward sloping ramp 30 constituting a planar metal plate, fastened between adjacent wall members 11 as by intervening connector rod means (not shown) which pass through suitable rolled over end portions 31 thereof and between the parallel wall members 11. In the course of such passage of the "back" cans from the lower end of the angularly disposed and downwardly sloping linear rail section 20 to the ramp 30, it will be noted that an intervening guide plate 35 is mounted along the left hand or front side of the vertical can passageway as shown in FIG. 1. Such plate 35 is constructed similar to the ramp 30 and comprises a planar plate member having rolled over ends 36 receptive of mounting rods; the width of the plate 35 as well as ramp 30 being substantially that of the desired spacing between adjacent walls 11, 11 in the magazine. Importantly guide plate 35 is disposed at an angle to the vertical so as to converge toward the linear rail portion 28 of the combination rail member 25 thereby forcing the "back" cans to gravitate into the lower curvilinear portion 26*a* of member 25, as illustrated. The slope of the guide plate 35 is such as to constitute a restricting throat at the lower end thereof through which the "back" cans 18*a* pass and which throat has a dimension slightly greater than the normal diameter of a conventional, standard 12 oz. metal beverage can. By way of example the distance between the lower end 36 of the guide plate 35 and the opposing linear rail section 28 of member 25 will be in the order of 2.875" for use with a conventional beverage can diameter of 2.6". The upper end of guide plate 35, of course, is in a position of non-interference with the free gravitational fall of cans 18*a* exiting from serpentine track A.

The discharge ramp 30 extends linearly at a downward sloping angle of approximately 15° to the horizontal in the particular illustrated embodiment and serves to gravitationally convey, by rolling action, the several "back" cans 18*a* toward the vending gate 40 of an electromechanical solenoid operated vending mechanism of the order more specifically described in U.S. Pat. No. 3,613,945 issued Oct. 19, 1971, or the equivalent thereof. In any event the single vend mechanism 41, indicated in dotted lines in FIG. 1, serves to control the discharge and release of cans from ramp 30 in response to customer deposit of appropriate coin value according to known practice.

With reference now to FIGS. 1 and 2 of the drawings, a wedge feed system for integrating the "back" cans flowing from serpentine track A with the "front" cans flowing from serpentine track B will now be set forth.

It will be noted with reference to the front serpentine track B that cans exiting from the linear portion 14 of the curvilinear section 12 roll onto the upper surfaces of opposing linear guide rail 20, on opposing walls 11 which cooperate with over disposed opposing guide rails 45, constructed like rails 20. Such guide rails 20 and 45, on opposite sides of the magazine column formulate a linear discharge ramp for conveying "front" cans downwardly toward the guide plate 35. This relationship will be readily recognized from FIG. 1 of the drawings. As each "front" can 18 engages the back side of the guide plate 35 as shown in FIG. 1, it falls vertically downwardly, and importantly is guided to a position directly over the V-shaped gap 46 created by adjacently engaged "back" cans on ramp 30 and on the lower end of the curvilinear rail section 26*a* associated with serpentine track A. As the "back" cans gravitate toward the vend gate 40 along ramp 30 in response to periodic operation of such vend gate to dispense a can, the V-shaped gap 46 opens up slightly under the weight of the overdisposed "front" can 18 as illustrated. This provides a relatively larger spacing 47 between the adjacent "back" cans on ramp 30. This relationship is brought about principally by virtue of a downwardly inclined wedge plate 50 which acts on "front" cans 18 along with a differential in vertical gravity forces acting on cans 18 and the ramp supported cans 18*a*. The body 51 of wedge member 50 has upwardly turned side flanges 52 on the opposite lateral edges thereof for connection with the opposing walls 11, 11 of the magazine section as well as upwardly turned ends 53, the uppermost of which in the sloping attitude of the wedge member 50, fits beneath the downwardly turned lip portion 24 of the short linear rail section 20 associated with the serpentine track column B.

As shown in greater particular in FIG. 2 of the drawings, the wedge body 51 is formulated with a centrally and longitudinally extending flattened crown portion 54 medially of its width which is bordered by angularly disposed flank portions 55. The flattened crown portion 54 comprising a generally rectangular area of engagement located to engage a can 18 substantially medially of its cylindrical body. This crown formation minimizes the tendency of the can to turn or slew thereby preventing one end of the can from hanging up on one of the walls 11. To further reduce frictional engagement between "front" cans 18, (which underengaged the wedge member) and the latter, it has been found that utilization of stainless steel to construct the wedge member 50 is desirable. In this respect a full hard tempered type 301 stainless steel having a RMS of 8–10 has been found workably satisfactory for the wedge member according to this invention.

To complete the discharge structure, a rail 60 is attached to walls 11 in linear alignment with the ramp member 50 as shown, in FIG. 1. Rail 60 supports a stop member (not shown) for preventing can movement along ramp 30 when the vend mechanism is removed for repairs, as more fully set forth in my aforenoted copending application.

Importantly, it should be noted that the ramp member 30 is in converging relationship with wedge member 50 which is disposed at a generally critical angle of convergence relative to the ramp member of substantially $16\frac{1}{2}°$ plus or minus 1° with the upper end of the wedge member being spaced from the ramp a distance less than two can diameters.

With this relationship of convergence, it has been found that vertically moving "front" cans exiting from the lower end of the discharge for track B (i.e., linear ramp members 20 and 45) smoothly and positively integrate with the relatively transversely flowing "back" cans on ramp 30 exiting from the generally vertically oriented column of "back" cans 18*a* discharged from the rearwardly disposed serpentine track A.

As noted heretofore the initial engagement between "back" cans 18*a* moving along the ramp 30 and the downwardly moving and gravitationally merging "front" cans 18 is at a generally V-shaped gap 46 between two adjacent "back" cans.

Thereafter the "back" cans separate slightly to provide an enlarged gap 47 therebetween in response to downward movement of an overdisposed "front" can 18 engaged by wedge member 50. As cans continue to be dispensed periodically by the vend mechanism 41, the "front" can over the enlarged gap 47, continues to move downwardly under the wedging action of the wedge member 50 and gravity to create a larger gap 61 between the two adjacent "back" cans engaged thereby (see FIG. 1). Upon release of a can by the vend mechanism, the overdisposed can 18 is wedged downwardly into and enters the gap 61 which continues to enlarge as the cans gravitate toward the vend mechanism. Thus, cans from the "front" track B are positively integrated with those of the "back" track A such that the vend mechanism 41 vends alternate cans from the two streams or columns of cans which periodically integrate and deplete the storage columns or tracks A and B on a first-in, first-out basis as mechanism 41 dispenses cans.

By eliminating the second vend mechanism for serpentine track A, additional can storage capacity is achieved in accordance with this invention. For example, whereas a double serpentine track magazine, in accordance with my aforenoted application Ser. No. 07/245,451 now U.S. Pat. No. 4,913,313, issued Apr. 3, 1990, may store sixty-one standard size cylindrical beverage cans, the same size magazine according to this invention stores sixty-six cans, thus achieving that desirable objective of this invention. Further since the "front" and "back" cans integrate in alternate fashion as illustrate din FIG. 1, it is immaterial as to the order of loading the track columns A and B which is of great convenience to the machine attendant.

From the foregoing is believed that those familiar with the art will readily recognize and appreciate the novel advancement of the present invention over the prior art and will understand that while the same has herein been described in association with a preferred embodiment illustrated in the accompanying drawings, the same is nevertheless susceptible to variation, modification and substitution of equivalents without departing from the spirit and scope of the herein described invention which is intended to be unlimited by the foregoing except as may appear in the following appended claims.

The embodiments of the invention in which an exclusive property or privilege is claimed are defined as follows:

1. In an automatic coin-operated vending machine having a magazine for storing a plurality of like cylindrical articles, such as cans or bottles, the combination comprising:

a pair of vertically oriented track means for carrying a plurality of said articles;

said track means gravitationally feeding articles to the lower ends thereof whereat said articles are released for falling gravitational movement along two laterally separated, generally vertical movement paths;

generally horizontal, inclined, planar ramp means extending transversely beneath and laterally across the lower ends of both said track means;

said ramp means being spaced vertically below the lower ends of said track means in intersection relation with said vertical movement paths whereby to receive articles falling from both said track means;

first articles from a first of said track means being deposited directly onto the upper elevated end of said ramp means for rolling gravitational movement laterally therealong;

second articles from the other of said track means being deposited intermediate the ends of said ramp means directly onto the upper surfaces of adjacent first articles on said ramp means in such a manner and location as to be superposed on said adjacent first articles at and along an upper V-shaped spacing therebetween, and generally planar, elongated wedge means mounted in generally horizontal, overlying convergent relationship with said ramp means, the upper elevated end of said wedge means being located laterally to one side of and immediately downstream from the area of interengagement between said first and second articles for cooperation with said ramp means to effectively integrate said first and second articles into a single column movable along said ramp means such that said first and second articles are alternately disposed in said single column.

2. The combination of claim 1, and a single vend mechanism disposed at the lower end of said ramp means for selectively releasing articles from said ramp means one by one.

3. The combination of claim 1, wherein said wedge means comprises a generally elongated planar member having a medially crowned area projecting outwardly of the plane thereof for overengaging a mid-section of each of said second articles moving therebeneath.

4. The combination of claim 1, wherein said ramp means is disposed at substantially 15° to the horizontal and said wedge means converges with said ramp means at an angle of substantially 16° for handling cylindrical beverage cans.

5. The combination of claim 1, wherein said track means comprise a pair of vertically oriented, back-to-back separated serpentine article carrying tracks comprising curvilinear and linear members mounted on opposing faces of adjacent vertically extending parallel side wall members.

6. The combination of claim 1, wherein said wedge means and gravity act to force said second articles between adjacent said first articles on said ramp means.

7. The combination of claim 1, wherein said ramp and wedge means have an angle of convergence of substantially 16° and said upper elevated end of said wedge means is spaced from said ramp means a distance slightly less than twice the diameter of one of said articles.

8. The combination of claim 7, wherein said wedge means comprises a generally planar member constructed of stainless steel having a low coefficient of frictional engagement with said articles.

* * * * *